United States Patent [19]

Kamei et al.

[11] Patent Number: 4,529,849

[45] Date of Patent: Jul. 16, 1985

[54] PUSH-BUTTON SWITCH AND A KEYBOARD COMPRISING THE SAME

[75] Inventors: Seisuke Kamei, Suzaka; Toshiaki Tanaka, Kawasaki; Kazutoshi Hayashi, Suzaka; Akira Tanaka, Suzaka; Ryohei Kinoshita, Suzaka, all of Japan

[73] Assignee: Fujitsu Limited, Kawasaki, Japan

[21] Appl. No.: 596,288

[22] Filed: Apr. 3, 1984

[30] Foreign Application Priority Data

Apr. 8, 1983 [JP] Japan ..... 58-61793

[51] Int. Cl.[3] ..... H01H 3/12

[52] U.S. Cl. ..... 200/5 A; 200/159 B; 200/340

[58] Field of Search ..... 200/5 A, 159 B, 340, 200/159 B, 159 A

[56] References Cited

U.S. PATENT DOCUMENTS 4,467,150 8/1984 Leitermann et al. ..... 200/159 B X

*Primary Examiner*—A. D. Pellinen

*Assistant Examiner*—Morris Ginsburg

*Attorney, Agent, or Firm*—Staas & Halsey

[57] ABSTRACT

A novel stroke converting mechanism for a push-button switch is disclosed. The stroke converting mechanism is for providing a push-button switch or a keyboard comprising the push-button switches with features such as low cost, low profile, and light and comfortable key touch. The stroke converting mechanism is made from a plate of metal such as 18-8 stainless steel, and fabricated by a single shot of press or by an etching of the plate in a batch process. The delineated plate is then shaped into a specified form by die press. In spite of the simple structure, the stroke converting mechanism can provide a sufficient stroke conversion ratio, e.g., about 4 mm of the key top to a displacement of about 1 mm necessary for actuating a couple of make-break contacts. And also, it reduces the necessary depression force on the key top to a half of the force required for actuating a make-break contacts, and provides a reduction in the height of a push-button switch or a keyboard as much as 3 mm or more.

21 Claims, 18 Drawing Figures

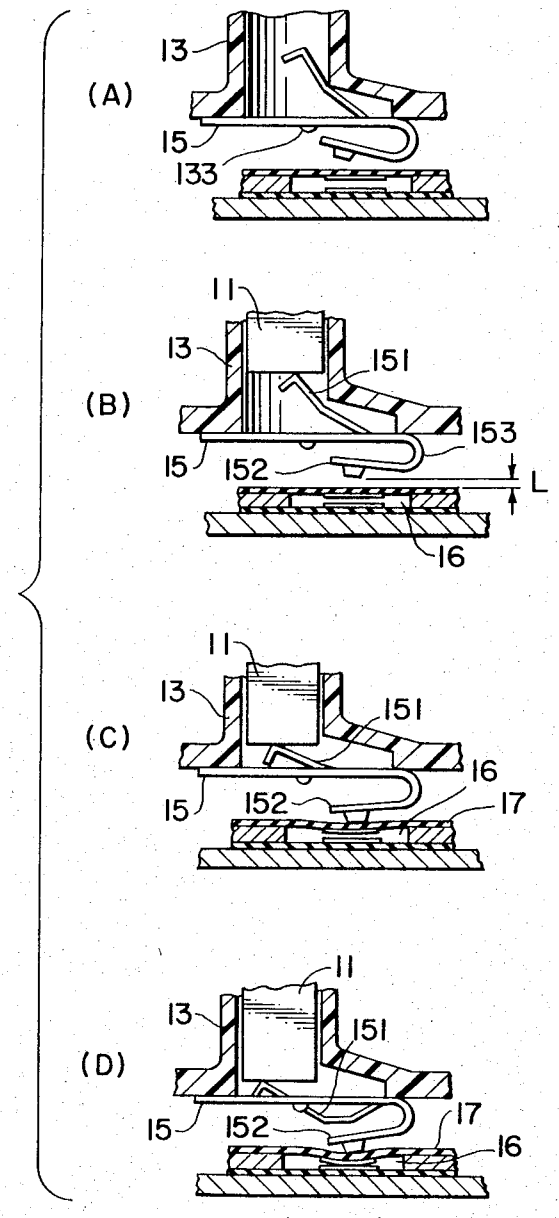
FIG. 5.
FIG. 4.
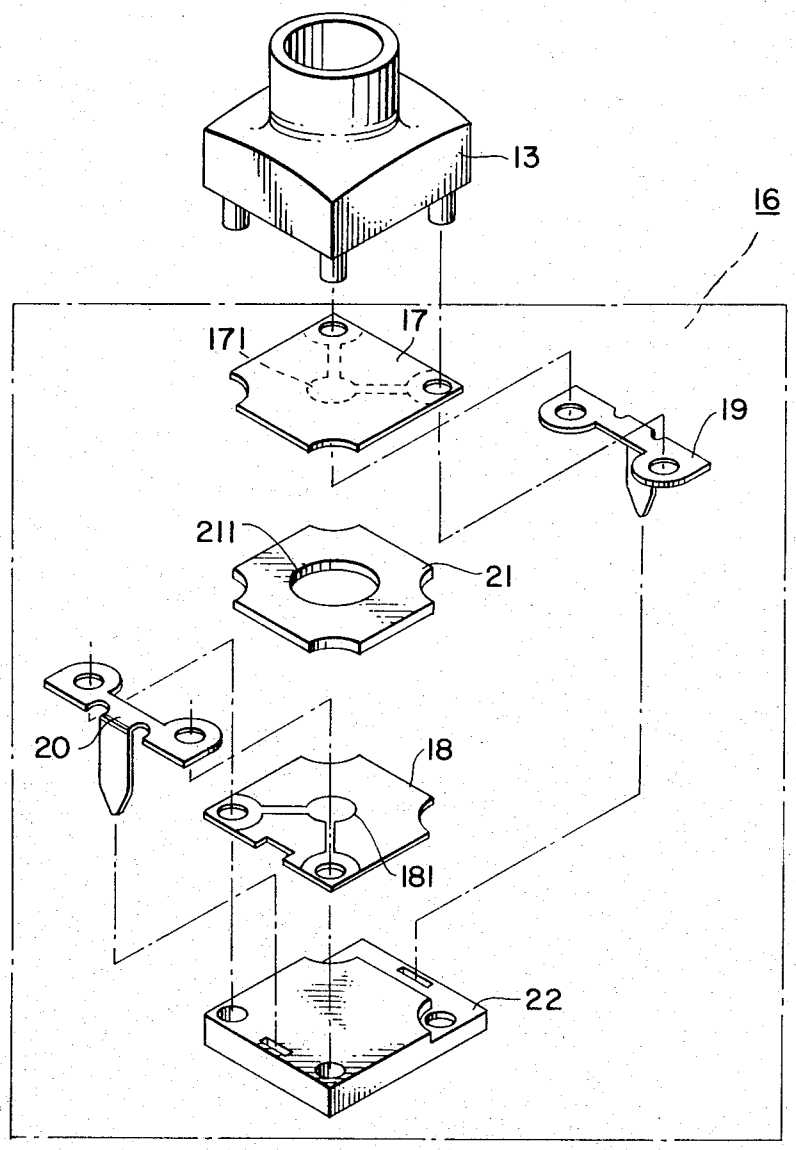

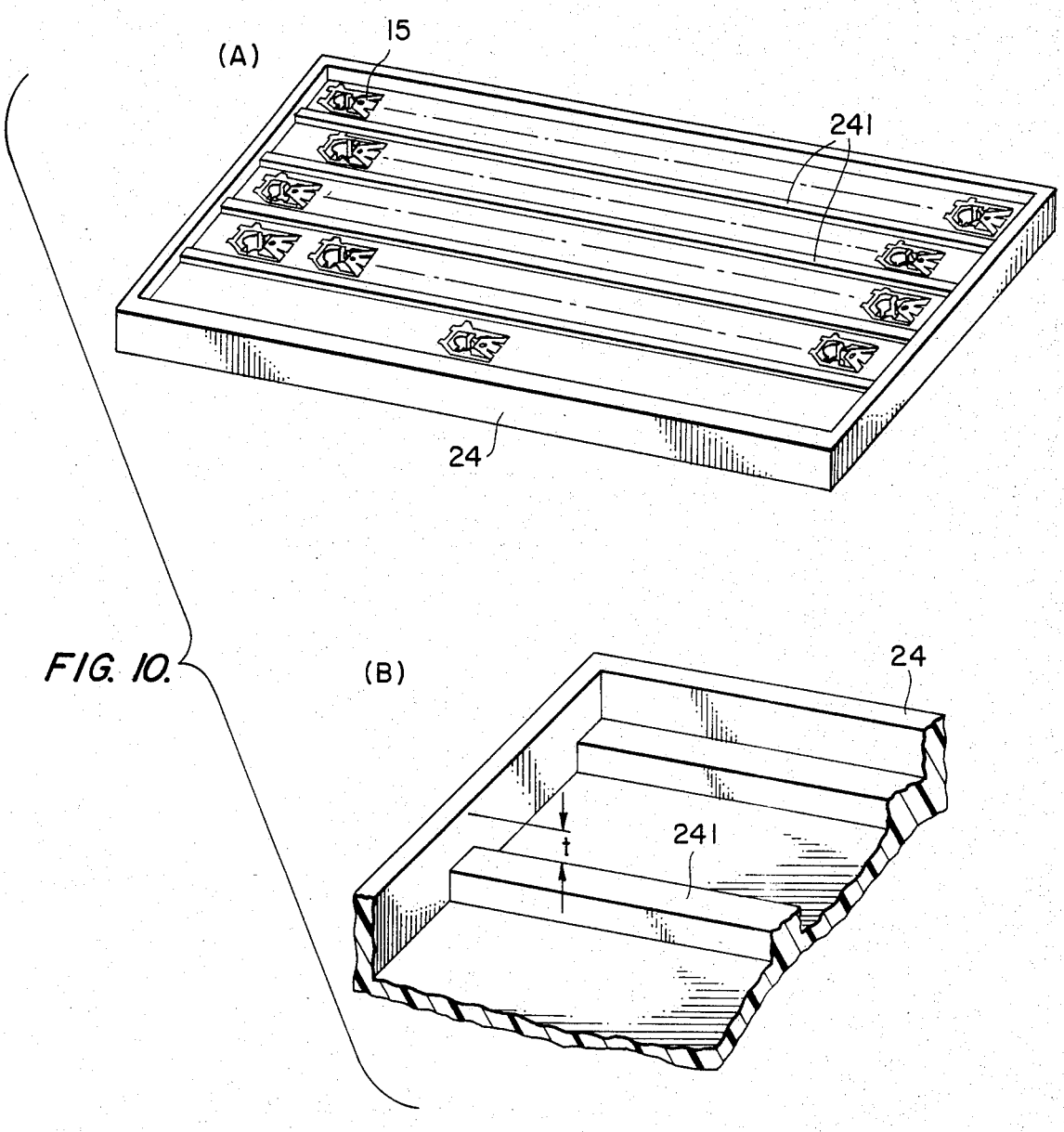
FIG. 10.
FIG. 11.
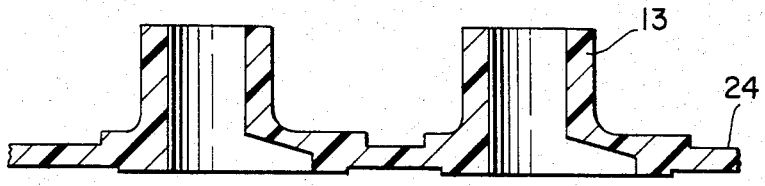

PUSH-BUTTON SWITCH AND A KEYBOARD COMPRISING THE SAME

BACKGROUND OF THE INVENTION

This invention relates to a push-button switch and a keyboard, particularly to a stroke converting mechanism suitable for a push-button switch employing a so called a membrane switch.

Push-button switches are incorporated as inputting means in various electronic equipment. A typical usage of the push-button switch is in the keyboard of an electronic typewriter or that of an I/O (input/output) equipment in computer systems. Since the operator of such a keyboard is usually typing the push-buttons repeatedly for a long time, it is necessary to consider the design of a keyboard or its push-button switches from the stand point of not only efficiency but also human engineering.

The requirements for the push-button switches are: (1) adequate actuating pressure on the key top, desirably about 60 grams; (2) adequate stroke length of the key top, about 4 mm; (3) initial pressure threshold to prevent a failure input due to mistouching on the key top, about 20 grams; and (4) smooth sliding of the key top. In order to keep the smooth sliding of the key top, usually the surface of a slider, on which the key top is loaded, should provide a housing with a contact length of more than about 4 mm.

On the other hand, recent fashion in electronic equipment requires thin type keyboards, the so called low profile keyboards. In response to such requirements, a push-button switch or a keyboard incorporating a new switch called the membrane switch has been proposed. In the membrane switch, a set of make-break contacts is formed on the inner surfaces of two flexible insulating sheets which are separated by a spacer to face each other with a gap of a few tenths of a millimeter. The make-break contacts take the make position when one of the flexible insulating sheets is caused to sag by an external force given through the key top.

The membrane switch is advantageous for providing low profile keyboards and also for cutting the cost of keyboards, however, its small gap between the make-break contacts results in an undesirable key touch, if the stroke of the key top is directly transmitted to it. Therefore, a stroke converting mechanism is needed to make the membrane switches match the keyboards. The stroke converting mechanism converts a given stroke length of a key top of a push-button switch to a desired small displacement necessary for actuating make-break contacts like those in a membrane switch.

FIG. 1 is a cross-sectional view illustrating a push-button switch having a prior art stroke converting mechanism. Referring to FIG. 1, key top 1 is secured to slider 2 which is movably installed in housing 3, which has been secured to top panel 7. In the slider 2, a push rod 6 is movably inserted. When the key top 1 is free, the slider 2 and push rod 6 are lifted at their topmost positions by spiral springs 4 and 5. Below the bottom end of push rod 6, a set of make-break contacts 91 and 92 are placed to face each other with a distance of about 0.1 mm. The make-break contacts 91 and 92 are formed, for example, on the inner surface of a flexible insulating sheet 81 like polyester membrane and another insulating sheet 82, both of which are separated by spacer 8 and secured on the surface of base panel 10. The insulating sheet 82 is not required to be flexible, in general, and may be a rigid member like a printed circuit board.

In the situation as shown by FIG. 1, the key top is pushed up by the spiral spring 5, and pressed to the top of the housing 3. Accordingly, the bottom end of the push rod 6 is separated from the flexible insulating sheet 81 with a distance of about 1 mm, thus the make-break contacts 91 and 92 are in the break position. When the key top 1 is depressed with a sufficient force, the spiral spring 5 is compressed first, then the spiral spring 4 begins to shrink so as to balance the resetting forces of both springs. Until the push rod 6 touches the flexible insulating sheet 81, the ratio of the displacement of the slider 2 to that of the push rod 6 is determined by the spring constants of the spiral springs 4 and 5. When the foot of the push rod 6 touches the flexible insulating sheet 81 and initiates its deformation, the tension of the sheet 81 is incorporated in the resetting force against the key top 1, and after the make-break contacts 91 and, 92 take the make position, the restitution of the key top 1 depends on only the spiral spring 4. Thus, the stroke length (D) of the key top 1 is converted to the displacement (d) of the push rod 6.

The push-button switch having the stroke converting mechanism as shown in FIG. 1 requires a number of complicated parts, and therefore results in a high cost. Moreover, the stroke converting mechanism has difficulty in providing a low profile push-button switch or keyboard, because of the triple cylindrical structure comprising the housing 3, slider 2 and push rod foot 6, which inevitably leads to a voluminous structure of the housing 3. This suggests that, if the housing 3 has a structure so slim that its upper portion, at least, is contained in the key top 1, a low profile can be achieved while keeping the above mentioned contact length for eliminating the loose sliding of the key top. Furthermore, in the stroke converting mechanism as shown in FIG. 1, the external pressure applied on the key top 1 is directly transmitted to the make-break contacts 91 and 92. In other words, it is required to depress the key top 1 with a force at least equal to that necessary for actuating the contacts. This means that operators must depress the key top 1 with a force more than 100 grams, occasionally up to 200 grams. Such a large force gives the operators an unpleasant key touch and is apt to result in the physical symptoms well known as an occupational disease of keypunchers.

SUMMARY OF THE INVENTION

The present invention is intended to provide a push-button switch and a keyboard having a new stroke converting mechanism to overcome the problems inherent in the prior art push-button switches, and therefore:

it is an object of the present invention to provide a low cost push-button switch and/or keyboard;

it is another object of the present invention to provide a low profile push-button switch and/or a keyboard; and it is still another object of the present invention to provide a push-button switch and/or a keyboard operable with a smaller depressing force.

The above objects can be accomplished by providing a push-button switch, or by providing push-button switches in a keyboard, with a novel stroke converting mechanism. The stroke converting mechanism is made from a metal plate or ribbon, which is formed by a stamping of a single shot press or by an etching, for example, into a leaf including a number of the patterns for the stroke converting mechanism, which is then bent to have a specified shape. In the final step, the shaped leaf is cut off into individual stroke converting mechanisms. The stroke converting mechanism provides a sufficient stroke conversion ratio and a light depression, which are both needed for actuating a membrane switch, thanks to the leverage action of the arms. Furthermore, the compactness of the stroke converting mechanism enables the reduction of the size of the housing, and thus a low profile push-button switch or keyboard can be provided.

Detailed structure and features of the stroke converting mechanism will be clear from the following description of the preferred embodiment with reference to the accompanying drawings.

BRIEF DESCRIPTION OF THE DRAWINGS

FIG. 4 is another exploded view of an exemplary structure of the electrical parts used in the push-button switch shown in FIGS. 2(A) and (B);

FIGS. 5(A) through 5(D) are schematic diagrams illustrating the action of the stroke converting mechanism shown in FIGS. 2(A) and (B).

FIG. 10(A) is a perspective view illustrating the bottom side of a keyboard of the present invention;

FIG. 10(B) is a partially enlarged perspective view showing the steps formed on the bottom side of a keyboard as shown in FIG. 10(A); and FIG. 11 is a cross-sectional view illustrating a unified structure of the housing and the case.

Through the figures, like reference numerals designate like or corresponding parts.

DESCRIPTION OF PREFERRED EMBODIMENT

Figure 2A:
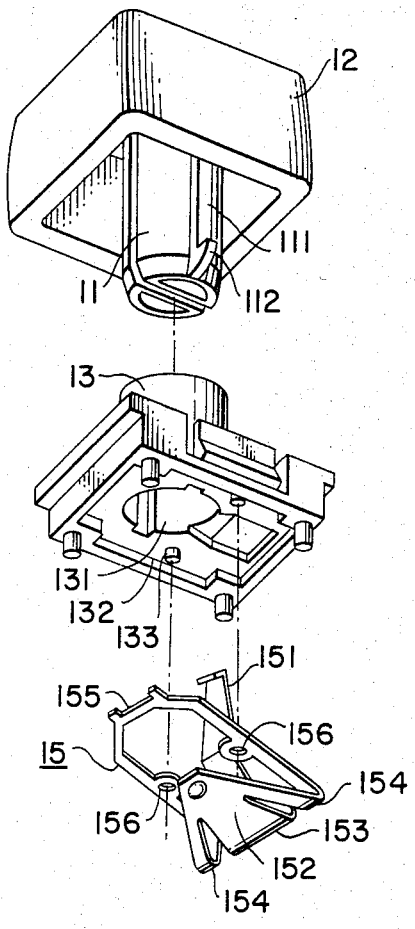
FIGS. 2(A) and (B) are views of an exemplary structure of mechanical parts used in a push-button switch of the present invention.

FIGS. 2(A) and (B) are perspective views of an embodiment of a discrete push-button switch of the present invention. Referring to the figure, a slider 11 having a key top 12 on its top end is movably installed in the guiding hole 131 of a housing 13. On the side surface of the slider 11, two spline teeth 111 (one of which is not shown) are formed along the axis of the slider 11, while on the inner surface of the guiding hole 131, two grooves 132, each of which fit to each of the spline teeth 111, are formed. At the tip of each of the spline teeth 111 is formed a hook 112 to prevent the slider 11 from dismounting from the housing 13. On the bottom face of the housing 13, a stroke converting mechanism 15 is placed.

The stroke converting mechanism 15 comprises a first arm 151, a second arm 152, a first bend 153, a couple of second bends 154, and a frame 155. The tip of the first arm 151 obliquely extends upward and pushes up the slider 11, while the tip of the second arm 152 is located above the switch 16 having a couple of make-break contacts. Details of the switch 16 will be described later (see FIG. 4).

The first and second arms 151 and 152 are combined with each other at their other ends, and therefore, they extend to the same side with respect to the first bend 153. Each second bend 154 is situated on a respective side of the first bend 153, and connects the tip of the second arm 152 with the frame 155. Thus, the first arm 151 and the second arm 152 are supported to take the position as shown in the cross-sectional view of FIG. 2(B), when the frame 155 is secured to the bottom face of the housing 13. In FIG. 2(A), holes 156 on the frame 155 are formed for accepting rivets or self-locking studs 133 etc. for the securing.

Figure 3:
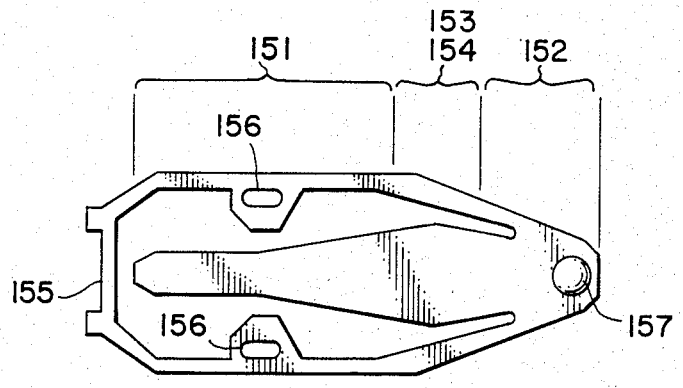
FIG. 3 is an illustration of the stroke converting mechanism of the present invention.

FIG. 3 illustrates the stroke converting mechanism 15 as fabricated by stamping or etching from a metal plate or ribbon. An exemplary material for the spring plate is a 0.13 mm thick plate of 18-8 stainless steel. A number of such stroke converting mechanisms as shown in FIG. 3 can be fabricated through a single press or batch process of etching. Then they are shaped into the bent structure as shown in FIG. 2(A) by using a die for bending, before being cut off into individual parts. The protruding portion 157 formed at the tip of the second arm 152 is for concentrating the pressure on the make-break contacts.

Figure 1:
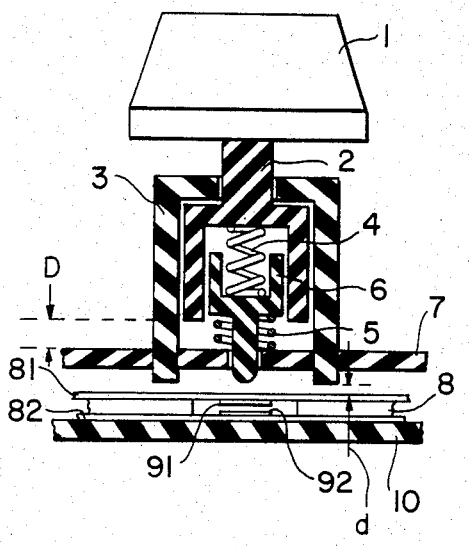
FIG. 1. (PRIOR ART)
FIG. 1 is a cross-sectional view of a push-button switch having a prior art stroke converting mechanism.

FIG. 4 is another exploded view of an exemplary structure of electrical parts comprising a membrane switch 16 used in the push-button switch shown in FIG. 2(A). Referring to FIG. 4, each of electrical contacts 171 and 181 constituting a pair of make-break contacts is formed on the surface of the insulating sheets 17 and 18, respectively. As mentioned in the description of the prior art push-button switch shown in FIG. 1, the insulating sheet 17 must be flexible, however, the insulating sheet 18 is not required to be flexible in general, and may be a rigid printed circuit board, for example. Each of the contacts 171 and 181 is electrically connected to corresponding terminals 19 and 20. Between the insulating sheets 17 and 18, a spacer 21 of thickness about 0.125 mm, for example, is placed. The spacer 21 has an aperture 211, through which the contacts 171 and 181 face each other. The stack of the insulating sheets 17 and 18, the terminals 19 and 20, and the spacer 21 is bound together between the housing 13 (see FIG. 2(B)) and the bottom plate 22. Thus, a complete assembly of the push-button switch as shown in FIG. 2(B) is obtained.

Actuation of the make-break contacts of the push-button switch is as follows.

Figure 2B:
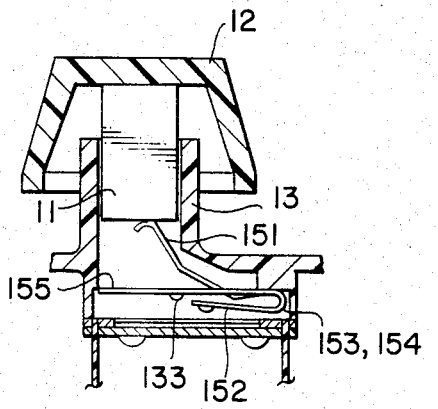

FIGS. 5(A) to (D) are schematic diagram illustrating the action of the stroke converting mechanism 15, as shown in FIG. 2(B). FIG. 5(A) shows the situation where the slider 11 has been removed from the housing 13, and the stroke converting mechanism 15 is free from stress. When the slider 11 installed in the housing 13 is at its topmost position as shown in FIG. 5(B), the tip of the first arm 151 is slightly depressed by the slider 11. With this depression, both the first arm 151 and the second arm 152 move pivotally around the first bend 153. It is considered that the second bends 154 are mainly responsible for the restitution of both arms 151 and 152 against the depression. By the initial depression as in FIG. 5(B), an initial pressure of about 20 grams is given to the stroke converting mechanism, however, the tip of the second arm 152 is separated for a clearance "L" from the switch 16 having make-break contacts.

The pivotal movement of the first arm 151 and the second arm 152 around the first bent portion 153 arises because the shift of the first bend 153 in the right hand direction on FIGS. 5(A) through 5(D) is inhibited by the side beams of the frame 155. Since the bend 153 tends to move up when the tip of the first arm 151 is depressed by the slider 11, the movement of the bend 153 is stopped by the bottom face of the housing 13.

When the tip of the first arm 151 is further depressed until the tip of the second arm 152 begins to depress the switch 16 as shown in FIG. 5(C), the flexible insulating sheet 17 is bent, and its tension is given to the tip of the second arm 152 as a resetting force. After the make-break contacts on the insulating sheets 17 and 18 has been actuated by the depression, the movement of the tip of the second arm 152 is stopped. In this situation, the first bend 153 can no longer pivot, and accordingly, the first arm 151 is elastically deflected by the increasing pressure of the slider 11, as shown in FIG. 5(D). That is, after the actuation of the make-break contacts has been completed, the bending stress of the first arm 151 is mainly responsible for the resetting force against the depression of the slider 11.

Figure 6:
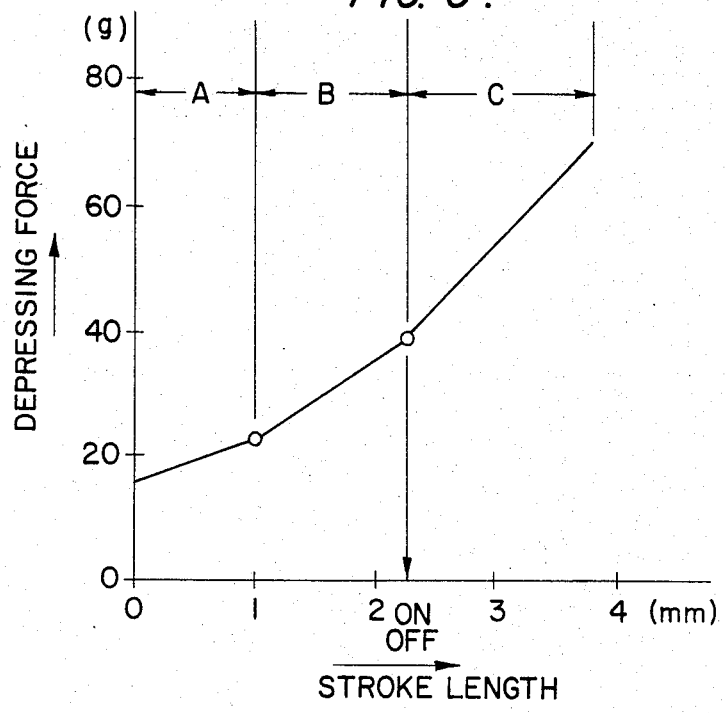
FIG. 6 is a graph showing the relation between the stroke length of the key top and the depressing force to the key top.

FIG. 6 is a graph showing the relation between the stroke length of the key top 12 and the force depressing the key top 12, i.e. the relation between the stroke length of the slider 11 and the resetting force being applied on it. As seen in FIG. 6, the curve consists of three portions; curve (A) is the region from stroke length 0 to about 1 mm, which corresponds to the change from the beginning of the depression to the situation until the tip of the second arm 152 touches the switch 16. In the region, change of the depressing force (equal to the resetting force against the key top) is about 6 grams from an initial value of about 16 grams. Curve (B) is the region from stroke length of about 1 mm to about 2.3 mm, in which a change of the depressing force of about 18 grams includes an increment caused by the tension of the flexible sheet 17. Curve (C) is the region from a stroke length of about 2.3 mm to about 3.8 mm, where the change of the depressing force is about 30 grams, and maximum force is about 70 grams. This region corresponds to the period in which the deflection of the first arm 151 exists, as shown in FIG. 5(D).

As mentioned above, the horizontal distance between the point of the first arm 151, on which the slider 11 applies a pressure, and the pivot (the first bend 153) is twice or more of that between the protruding portion 157 (see FIGS. 2 and 3) and the pivot. Therefore, on the make-break contacts is applied as large a pressure as twice that of the depressing force applied to the key top. In other words, the pressure operatively required on the key top is less than a half of the actual force necessary for actuating the make-break contacts.

The stroke length allowed for the key top 12 is provided by the pivotal movement and the deflection of the first arm 151; the former provides the tip of the first arm 151 with a displacement more than twice that necessary for actuating the make-break contacts, with an extra displacement independent of the pivotal movement. As a result, a stroke length of about 4 mm is allowed for the key top during actuation of the make-break contacts having a small gap like in a membrane switch.

Figure 7:
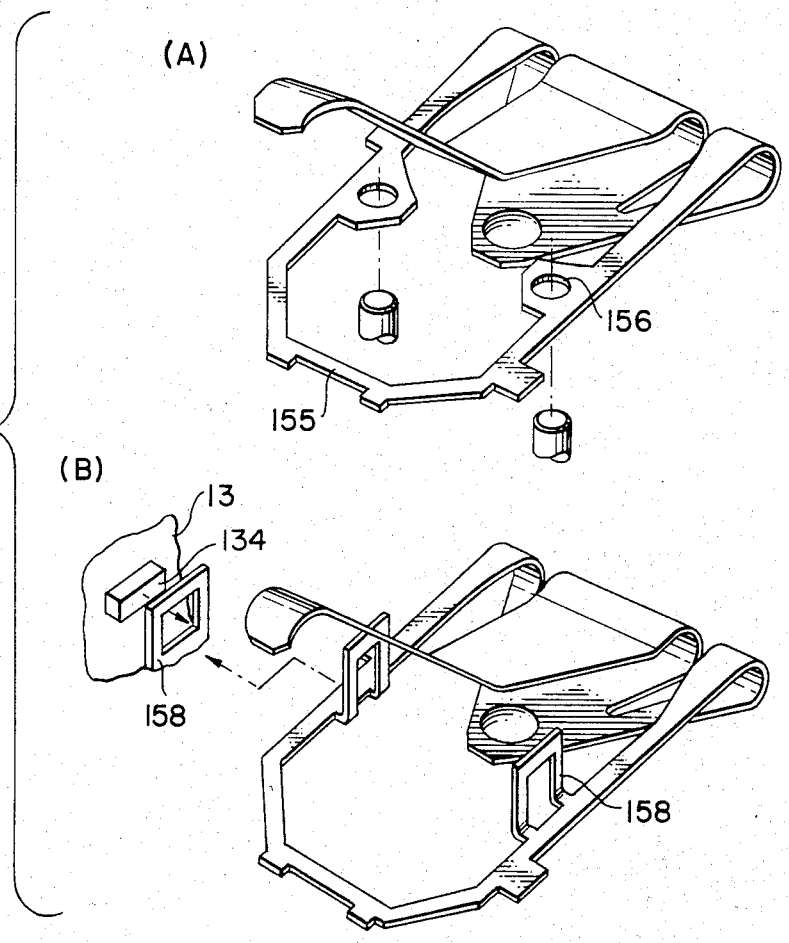
FIGS. 7(A) and 7(B) are perspective views for explaining some exemplary methods for securing the stroke converting mechanism to a housing.

FIGS. 7(A) and 7(B) are perspective views for explaining some exemplary methods for securing the stroke converting mechanism to the housing. In FIG. 7(A), a couple of holes 156 are formed in both side beams of the frame 155, as already shown in FIG. 2(A). In FIG. 7(B), a couple of tabs 158 each having an aperture are formed on both side beams of the frame 155, and a stud 134 formed in the housing 13 is fitted to each aperture.

Figure 8:
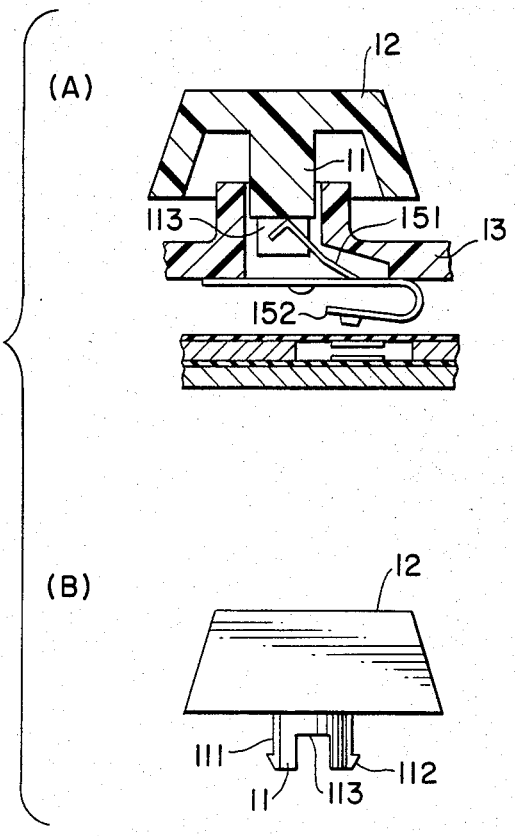
FIG. 8(A) is a cross-sectional view of a push-button switch of the present invention, in which the slider has a slot at its bottom end.
FIG. 8(B) is a front view illustrating an exemplary structure of the slot shown in FIG. 8(A)

FIG. 8(A) is a cross-sectional view of another push-button switch embodying the present invention. In this embodiment, the height of the switch is further decreased compared with FIG. 2(B). That is, the slider 11 has a groove 113 at its bottom end as shown in FIG. 8(B), which is a front view illustrating an exemplary structure of the groove 113 shown in FIG. 8(A).

Since the simple and small sized structure of the stroke converting mechanism of the present invention makes the housing compact enough to be contained in the key top as shown in FIG. 2(B), low profile structure of a push-button switch or a keyboard has substantially been accomplished, however, the slot 113 enables further advancing the low profile structure of the push-button switch or the keyboard. That is, as is easily understood from FIGS. 8(A) and (B), the slot 113 decreases the distance between the key top 12 and the tip of the first arm 151 as much as the depth of the slot, while permitting keeping the required length of the stroke of the key top 12 and also the length of the contact between the slider 11 and the guiding hole 131 in the housing 13.

Figure 9:
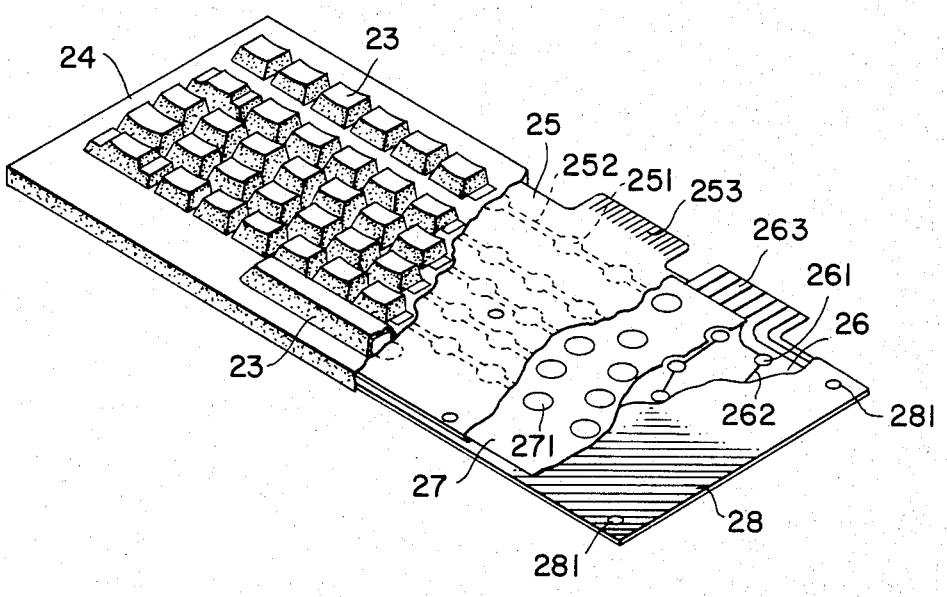
FIG. 9 is a partially cutaway perspective view illustrating an exemplary structure of a keyboard of the present invention.

FIG. 9 is a partially cutaway perspective view illustrating an exemplary structure of a keyboard of the present invention. Referring to FIG. 9, the keyboard comprises push-button switches 23 each having a stroke converting mechanism as shown in FIGS. 2(A) and (B) or FIGS. 7(A) and (B). Each push-button switch 23 is secured to the case 24 through a representative housing 13 (not shown in FIG. 9) in the same manner as in the discrete push-button switch described above.

In the keyboard, sets of the make-break contacts are formed on the large flexible insulating sheet 25 made of a material like polyester and another insulating sheet 26 which is not required to be flexible, in general, and may be a rigid printed circuit board, for example. On the bottom surface of the flexible insulating sheet 25, is disposed each contact 251 of each set, each being positioned just below the corresponding push-button switch 23, while on the upper surface of the insulating sheet 26, each other contact 261 of each set is disposed so as to face the corresponding contact 251. The contacts 251 in the same row are connected by a wiring 252, and led by a printed circuit to a corresponding terminal of the terminal portion 253, while the contacts 261 in the same line are connected by a wiring 262, and led by a printed circuit to a corresponding terminal of the terminal portion 263. Thus, the address of any selected set of the make-break contacts can be defined by detecting the selected row and line. Between the insulating sheets 25 and 26, a spacer 27 having apertures 271 each positioned at corresponding contacts 251 is placed. The insulating sheets 25 and 26, and the spacer 27 are stacked in the case 24, then placed on the back panel 28 which is secured to the case 24 by means of threads etc. supplied through the holes 281.

FIG. 10(A) is a perspective view of the bottom side of the keyboard when the back panel 28 and the insulating sheets 25 and 26, etc. shown in FIG. 9 are removed. FIG. 10(B) is a partially enlarged perspective view showing the steps formed on the bottom side. As illustrated in FIG. 10(A), the stroke converting mechanisms 15 are disposed in lines, and ribs 241 are formed to make banks between the lines. The height of the ribs 241 is lower than that of the periphery of the cover panel 24 in order to accept the total thickness (t) of the insulating sheets 25 and 26, spacer 27, and back panel 28, as shown in FIG. 10(B). Thus, when the sheets, etc. are accommodated in the case 24, each push-button switch and corresponding contacts constituting a set of make-break contacts can be precisely located at a specified position, without any special positioning measure.

FIG. 11 is a cross-sectional view illustrating a unified structure of the housing 13 and the case 24. This structure is easily accomplished by using an injection molding method, and eliminates the need for the work for mounting the individual housings onto the case. The unified structure facilitates automated mounting of the stroke converting mechanisms 15 onto the case 24, thus enabling cost reduction of the keyboard.

The invention has been described with respect to a preferred embodiment thereof, but it will be recognized that modifications and variations may be affected within the spirit and scope of the invention. For example, one or more slits may be formed along each of the second bends, in order to adjust the depressing force of the key top to provide a more comfortable key touch feeling. Also, the holes for securing the stroke converting mechanism to the housing may be formed on a back side beam of the frame. Furthermore, use of the stroke converting mechanism is not limited to push-button switches but is applicable to micro-switches, for instance.

We claim:

1. A push-button switch comprising:

a housing having a guiding hole;

a slider movably installed in the guiding hole of said housing and equipped with a key top, said slider having a bottom face;

a couple of make-break contacts; and a stroke converting mechanism for converting a given stroke length of the key top to a desired amount of displacement necessary for actuating said make-break contacts, wherein said stroke converting mechanism comprises a plate spring constituting a unified structure and having:

a first arm whose tip contacts the bottom face of the slider;

a second arm whose tip is located adjacent to the make-break contacts;

a first bend joining said first and second arms at respective ends thereof so that said first and second arms extend toward the same side of said first bend;

a frame for securing said stroke converting mechanism to said housing; and two second bends situated along respective sides of said first bend, a first end of each said second bend being combined with said tip of said second arm, and the other end of each said second bend being combined with said frame, wherein, upon the depression of the key top by an external pressure, said first arm and said second arm move pivotally around said bends from respective initial postions, and said tip of said second arm depresses said make-break contacts to cause them to take the make position, while upon removal of the external pressure to the key top, said first arm and said second arm move pivotally in the counter direction to restore the initial positions of said first and second arms, and said tip of said second arm frees said make-break contacts to cause them to take the break position.

2. A push-button switch as in claim 1, wherein said tip of said first arm is positioned further than said tip of said second arm from said first bend.

3. A push-button switch as in claim 2, the distance between said tip of said first arm and said first bend being more than twice of the distance between said tip of said second arm and said first bend.

4. A push-button switch as in claim 1, wherein at each said second bend is a slit extending from said tip of said second arm along said frame.

5. A push-button switch as in claim 1, wherein said frame is fixed to said housing at respective positions nearer to said second bends than to said tip of said first arm.

6. A push-button switch as in claim 1, wherein said stroke converting mechanism is secured to the housing so that at least one of said first and second bends contacts the bottom surface of said housing.

7. A push-button switch as in claim 1, wherein each of said make-break contacts is formed on an inner surface of a respective one of upper and lower insulating sheets stacked with spacer in between said insulating sheets, so that said couple of make-break contacts face each other with a specified gap, the upper one of said insulating sheets being flexible, and an aperture being provided in said spacer at the position corresponding to said make-break contacts.

8. A push-button switch as in claim 1, wherein at said bottom face of said slider is formed a groove running in the direction perpendicular to the axis of said slider, and said tip of said first arm moves in said groove to contact said slider.

9. A push-button switch as in claim 1, said tip of said second arm having a lower side face, wherein a protruding portion is formed on the lower side face of said tip of said second arm for actuating said make-break contacts.

10. A push-button switch as in claim 1, wherein said stroke converting mechanism is made from a plate of a spring material.

11. A keyboard comprising:

a case for accommodating elements constituting said keyboard;

a plurality of sets of make-break contacts within said case and disposed on the inner surfaces of two insulating sheets stacked on each other with a spacer in between said two insulating sheets, so that said make-break contacts of each said set face each other with a specified gap, the upper one of said insulating sheets being flexible, and said spacer having apertures at each position corresponding to each said set of said make-break contacts;

a plurality of push-button switches arranged in an array at the top of said case, each including:

a housing having a guiding hole;

a slider movably installed in said guiding hole of said housing and equipped with a key top, said slider having a bottom face; and a stroke converting mechanism for converting a given stroke length of said key top to a desired amount of displacement for actuating the respective make-break contacts, wherein said stroke converting mechanism comprises a plate spring constituting a unified structure and having:

a first arm whose tip contacts the bottom face of said slider of the corresponding push-button switch;

a second arm whose tip is located adjacent to the corresponding set of said make-break contacts;

a first bend joining said first and second arms to each other so that said first and second arms extend toward the same side of said first bend;

a frame for securing said stroke converting mechanism to said housing;

two second bends each of which is situated along a respective side of said first bend, wherein one end of each of said second bends is connected with said tip of said second arm, and each other end of each said second bend is connected with said frame;

wherein, upon the depression of each said key top by an external pressure, the corresponding first arm and second arm move pivotally around the respective first and second bends, from respective initial positions, and said tip of the respective second arm depresses a corresponding one of the respective set of make-break contacts to cause them to take the make position, and, upon removal of the external pressure, the respective first and second arms move pivotally in the counter direction to restore their respective initial positions, and said tip of the respective second arm becomes free of the corresponding set of make-break contacts to cause them to take the break position.

12. A keyboard as in claim 11, wherein said tip of each said first arm is positioned farther than said tip of the respective second arm from the respective first bend.

13. A keyboard as in claim 12, wherein the ratio of the distance between said tip of each said first arm and the respective first bend is more than twice of the distance between said tip of the respective second arm and the respective first bend.

14. A keyboard as in claim 11, wherein at each respective second bend is formed a slit extending from said tip of the respective second arm along the respective frame.

15. A keyboard as in claim 11, wherein each said frame is fixed to said housing at a position nearer to the respective second bends than to said tip of the respective first arm.

16. A keyboard as in claim 11, wherein each said stroke converting mechanism is secured to the respective housing so that the respective first and second bends contact said housing.

17. A keyboard as in claim 11, wherein at the bottom face of each said slider is formed a groove running in the direction perpendicular to the axis of the slider, and said tip of the respective first arm is located in said groove to contact said slider.

18. A keyboard as in claim 11, each said second arm having a respective lower side, wherein a respective protruding portion is formed on the lower side of said tip of each said second arm for actuating the respective set of make-break contacts.

19. A keyboard as in claim 11, wherein each said stroke converting mechanism is made from a plate of a spring material.

20. A keyboard as in claim 11, wherein each said housing is formed in a unified structure with said case.

21. A keyboard as in claim 11, wherein ribs are formed inside said case, each of said ribs having a step for positioning a respective set of said make-break contacts at a respective specified position with respect to the position of said tip of the respective second arm with a specified clearance therebetween.

* * * * *

UNITED STATES PATENT AND TRADEMARK OFFICE

CERTIFICATE OF CORRECTION

PATENT NO. : 4,529,849

DATED : July 16, 1985

INVENTOR(S) : Seisuke Kamei et al

It is certified that error appears in the above-identified patent and that said Letters Patent is hereby corrected as shown below:

[57] ABSTRACT, line 5, after "and" (first occurrence) insert --a--;
line 8, after "of" insert --a--;
line 10, after "by" insert --a--;
line 15, delete "And also" and insert --Also--;
line 17, delete "a" (first occurrence).

Column 1, line 10, delete "a";
line 19, "stand point" should be --standpoint--;
line 25, delete "on".

Column 6, line 22, "2(B)," should be --2(B), a--;
line 41, "representative" should be --respective--.

Column 8, line 31, after "stacked with" insert --a--.

Signed and Sealed this

*Third* Day of *December 1985*

[SEAL]

*Attest:*

*Attesting Officer*

DONALD J. QUIGG

*Commissioner of Patents and Trademarks*